United States Patent [19]

Kedzierski

[11] Patent Number: 4,644,613

[45] Date of Patent: Feb. 24, 1987

[54] LOCKING SLIDER FOR SLIDE FASTENER

[75] Inventor: Stanley G. Kedzierski, Saegertown, Pa.

[73] Assignee: Talon, Inc., Meadville, Pa.

[21] Appl. No.: 789,328

[22] Filed: Oct. 21, 1985

[51] Int. Cl.[4] ..... A44B 19/30

[52] U.S. Cl. ..... 24/421; 24/420; 24/424

[58] Field of Search ..... 24/421, 425, 420, 422, 24/424, 427, 428, 416, 417, 419

[56] References Cited

U.S. PATENT DOCUMENTS

| | | | |
|---|---|---|---|
| 2,524,574 | 10/1950 | Ryser | 24/421 |
| 2,549,380 | 4/1951 | Marinsky | 24/420 |
| 3,099,059 | 7/1963 | Huelster | 24/421 |
| 4,074,399 | 2/1978 | Kedzierski | 24/425 |
| 4,102,022 | 7/1978 | Aoki | 24/424 |
| 4,271,567 | 6/1981 | Aoki | 24/421 |
| 4,287,646 | 9/1981 | Kanzaka | 24/424 |
| 4,422,220 | 12/1983 | Oda | 24/421 |

FOREIGN PATENT DOCUMENTS

| | | | |
|---|---|---|---|
| 238508 | 11/1945 | Switzerland | 24/421 |
| 659290 | 10/1951 | United Kingdom | 24/421 |
| 1377451 | 12/1974 | United Kingdom | 24/421 |

*Primary Examiner*—Victor N. Sakran

*Attorney, Agent, or Firm*—Anthony A. O'Brien

[57] ABSTRACT

A locking slider assembly for a slide fastener includes only a slider body, a locking spring and pull tab. The three components can be automatically assembled substantially without component deformation. In one embodiment, the pull tab includes an eccentric locking spring release bar to effect spring release by rotation of the pull tab in a semi-automatic slider locking mode. In another embodiment, the locking spring is released by pulling of the pull tab in either direction of slide fastener operation and locking of the slide fastener occurs automatically upon release of the pull tab.

8 Claims, 7 Drawing Figures

FIG. 1
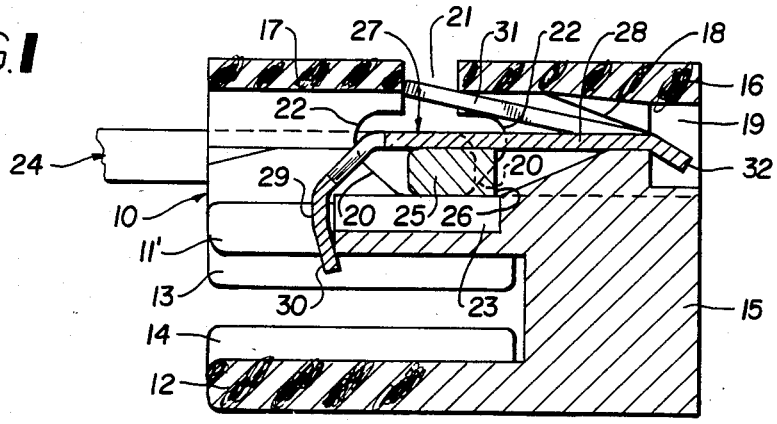
FIG. 2
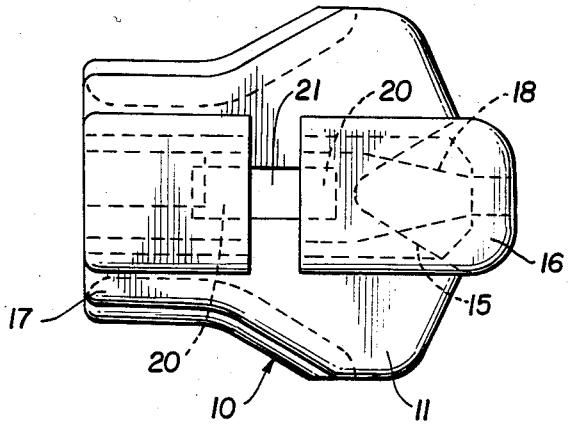
FIG. 3
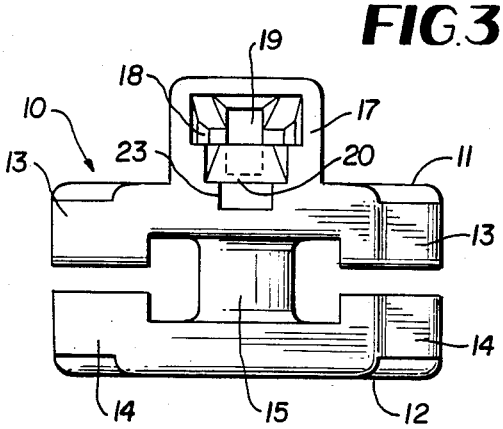
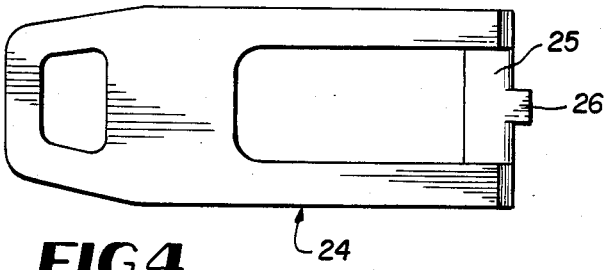
FIG. 4
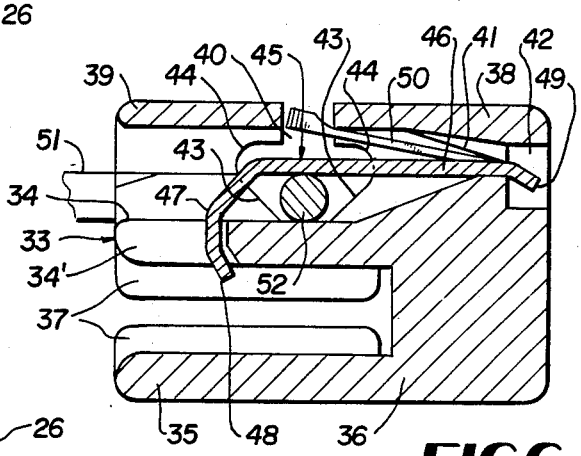
FIG. 6
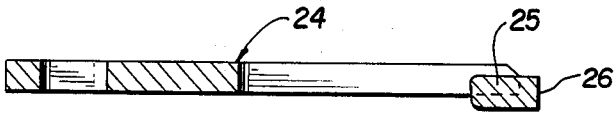
FIG. 5
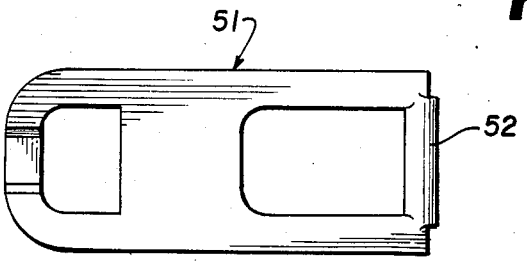
FIG. 7

LOCKING SLIDER FOR SLIDE FASTENER

BACKGROUND OF THE INVENION

1. Field of the Invention:

The present invention relates to locking sliders for slide fasteners and more particularly relates to a three component slider assembly of greater simplicity and lower manufacturing cost than known prior art locking sliders and being constructed for ease of assembling substantially without component deformation.

2. Description of the Prior Art:

Prior U.S. Pat. No. 4,074,399 discloses a three component slider assembly for a slide fastener in which a slider locking spring can be snappingly engaged with a slider body and serves to maintain a slider pull tab in assembled relationship between the slider body and locking spring. Both the slider body and the locking spring in this prior patent are rather complex in their constructions and the mode of assembling the three components of the locking slider is somewhat more difficult than ideally desirable.

U.S. Pat. No. 2,524,574 discloses a self-locking slider for slide fasteners which includes four components and requires a somewhat difficult and costly method of assembly in which a bail connected between a slider body and pull tab is first received in a cavity of the slider body and must subsequently be brought into engagement with the pull tab and closed.

SUMMARY OF THE INVENTION

An important object of the present invention is to provide a locking slider for a slide fastener which eliminates the stated drawbacks of the above-references prior art patents by providing a three component slider assembly of greater simplicity and ease of manufacturing, and which is susceptible of automatic assembling procedures substantially without component deformation.

A further important object of the invention is to provide a locking slider for a slide fastener which can provide semi-automatic locking of the slider in one embodiment, and full automatic locking in another embodiment.

Another object of the invention is to provide a locking slider assembly having improved and simplified geometry in its operating modes.

Still another object of the invention is to provide a locking slider assembly having a substantially simplified locking spring arrangement which serves to maintain a pull tab in assembled relationship with the body of the slider without the necessity of intervening connecting parts.

Other objects, advantages, and features of the present invention will become apparent from the following specification when taken in conjunction with the accompanying drawings.

BRIEF DESCRIPTION OF THE DRAWINGS

FIG. 1 is a longitudinal vertical section taken through a locking slider assembly according to one embodiment of the present invention.

FIG. 2 is a plan view of a slider body utilized in the slider assembly of FIG. 1.

FIG. 3 is an end elevation of the slider body.

FIG. 4 is a plan view of a pull tab forming a component of the slider assembly.

FIG. 5 is a longitudinal vertical section taken through the pull tab.

FIG. 6 is a view similar to FIG. 1 showing a second embodiment of the invention.

FIG. 7 is a plan view of a pull tab for the slider shown in FIG. 6.

DESCRIPTION OF THE PREFERRED EMBODIMENTS

Referring to the drawings in detail wherein like numerals designate like parts, a die cast slider body 10 includes upper and lower wings 11 and 12 having the usual spaced opposing flanges 13 and 14 at the opposite sides of the wings between which the tapes, not shown, of the slide fastener are received. At the forward end of the slider body 10 the wings 11 and 12 are connected by a post 15. Spaced forward and rear crown portions 16 and 17 are formed on the slider body 10 during the casting of the same. The forward crown portion 16 has a tapered internal chamber 18 communicating with a forward end recess 19, for a purpose to be described. Forward and rear inclined upwardly divergent ramp faces 20 are provided within the crown portions 16 and 17 on the opposite sides of a cross passage 21 separating the two crown portions. The tops of the inclined ramp faces 20 lead into circularly curved concave surfaces 22, for a purpose to be described. Beneath the cross passage 21, a longitudinal groove 23 is formed in the upper wing 11.

A slider pull tab 24 having a generally rectangular cross section through bar 25 at one end thereof is provided. The through bar 25 is offset somewhat downwardly from the plane of the pull tab 24, FIG. 5, and is provided at its transverse center with a guide lug or projection 26 adapted to be received in the groove 23 to guide the pull tab relative to the slider body 10 through a full 180° rotation of the pull tab 24, and particularly at the 90° position of the pull tab during its rotation.

A greatly simplified one-piece slider locking spring 27 is provided having a longitudinal body portion 28 carrying a rear end depending locking arm 29 terminating in a bottom locking tooth 30 which is somewhat inclined downwardly and forwardly with respect to the vertical. This locking tooth projects below the upper wing 11 of the slider body 10 and into the space occupied by the slide fastener coupling elements, not shown.

The locking spring 27 further comprises an upper inclined resilient leaf 31 which projects above the spring body portion 28 and diverges therefrom rearwardly. The locking spring 27 is assembled with the slider body 10 by inserting it forwardly through the interiors of the crown portions 17 and 16. When this is done, the resilient leaf 31 will be somewhat depressed by the top wall of crown portion 17 until the trailing end of the leaf reaches the cross passage 21. When this occurs, the leaf 31 will snap upwardly in the cross passage and engage the top wall of crown portion 16 and its rear end face will be locked against the forward end face of crown portion 17, as shown in FIG. 1.

When the locking spring 27 is being installed, the tapered chamber 18 will tend to guide the forward end of the spring toward the recess 19. When the spring enters this recess, its forward terminal 32 can be bent within this recess, as shown, for spring retention, and this is the only component deformation required in the assembling of the slider. Other than for this simple bending operation, the three slider assembly components are susceptible to automatic assembly procedures, as previously stated.

In the assembly process, prior to the installing of the spring 27, the narrow dimension of the pull tab through bar 25 can be inserted through the passage 21 and into the space between the ramp faces 20, followed by rotation of the pull tab 24 until the longer dimension of the rectangular through bar is positioned as shown in FIG. 1, longitudinally of the slider body. At this point, spring 27 is installed in the manner previously described and the spring maintains the pull tab 24 in assembled relationship with the slider body 10.

In the operation of the locking slider shown in FIGS. 1 to 5, in a semi-automatic mode, when the rectangular cross section through bar 25 is positioned as shown in FIG. 1, the slider locking tooth 30 will actively engage the slide fastener coupling elements, not shown, and the slider will be positively locked. At this time, the pull tab 24 will be down and parallel to the longitudinal axis of the slider. When the pull tab 24 is rotated approximately 30° from its position shown in FIG. 1, the camming action of the rectangular bar 25 on the locking spring 27 will elevate the locking tooth 30 and move it out of locking engagement with the coupling elements of the slide fastener, thus freeing the slider assembly to move along the fastener. The spring locking tooth 30 will remain released throughout the remainder of the full 180° rotation of the pull tab 24. When the pull tab 24 is returned to the position shown in FIG. 1, the spring locking tooth 30 will also return to the active locking position.

FIG. 6 of the drawings shows a further embodiment of the invention in which the locking of the slider by the locking spring is automatic. A slider body 33 very similar in construction to the slider body 10 has upper and lower wings 34 and 35 connected by a post 36 and provided with flanges 37. Spaced crown portions 38 and 39 on the slider body are separated by a cross passage 40. The crown portion 38 has a tapered chamber 41 leading to a forward end recess 42. Inclined ramp faces 43 are provided, as previously described, along with circularly curved concave surfaces 44 within the crown portions 38 and 39.

A locking spring 45 substantially like the spring 27 is assembled in the previously-described manner, and includes a body portion 46, locking arm 47, and a locking tooth 48. The spring also possesses a bent forward retaining terminal 49, for the purpose already described. However, the spring 45 differs from the spring 27 in that its snap locking resilient leaf 50 has its thickness reduced substantially along a major portion of its length. This reduction in thickness of the leaf 50 provides a lower spring pre-load resulting in greater flexibility and a lesser lifting force being required to release the tooth 48 of the spring from the locking position shown in FIG. 6.

A pulling tab 51 for the slider in FIG. 6 may include a circular cross section through bar 52, FIG. 7, which is not offset or eccentric to the plane of the pull tab. Through bar 52 is retained in assembled relationship with slider body 33 by the spring 45 in the same manner described in connection with the previous embodiment. The guiding groove 23 for the pull tab lug 26 in the prior embodiment is not required for the automatic locking slider and therefore has been eliminated. In both embodiments of the invention, the spring arms 29 and 47 and locking teeth 30 and 48 are received through slots 11' and 34' formed in the wings 11 and 34, respectively, FIGS. 1 and 6.

In the operation of the automatic locking slider, the pull tab 51 is simply grasped and lifted from the plane of the slider body 33 and may be pulled in either direction along the slide fastener. This elevating and pulling of the pull tab causes the bar 52 to engage and ride-up one or the other of the ramp faces 43 and seat itself in one of the concave surfaces 44. In so doing, the bar 52 will act on the body portion 46 of the spring 45 and lift the locking tooth 48 out of locking engagement with the coupling elements, not shown, of the slide fastener on which the locking slider is installed. When the pull tab 51 is released, the tension of the locking spring 45 will return the tooth 48 automatically to the slider locking position shown in FIG. 6, and the pull tab through bar 52 will be returned to the position shown in FIG. 6.

It can now be appreciated that both embodiments of the invention are characterized by extreme simplicity of construction, ease and convenience of assembling, comparatively low manufacturing cost, and reliability of operation. Either version of the locking slider has the ability to "ratchet lock" without damaging the slide fastener coupling elements. The several advantages of the invention over the known prior art should now be apparent to those skilled in the art.

Inasmuch as the present invention is subject to many modifications, variations, and changes in detail, it is intended that all the material in the aforegoing specification or in the accompanying drawings be interpreted as illustrative, and not in a limiting sense.

I claim:

1. A locking slider for a slide fastener comprising a slider body including spaced wings joined at corresponding ends by a connecting post, a pair of crown portions on the slider body separated by a cross passage and having substantially aligned internal passage means longitudinally of the slider body, said crown portions having spaced opposing inclined divergent ramp faces at their separated ends and arcuate concave surfaces leading from the ramp faces on opposite sides of the cross passage, a locking spring having a body portion inserted through said aligned passage means and having a retaining leaf in divergent relationship to the spring body portion adapted to snap lockingly into engagement with an end face of one of said crown portions within said cross passage, a locking tooth on said spring at one end of the spring body portion extending generally transversely of the spring body portion beyond one side thereof and transversely of the longitudinal axis of the slider body, the slider body having a slot near one end thereof through one of said wings receiving the locking tooth whereby the locking tooth may engage coupling elements of a slide fastener between said wings, a pull tab for the locking slider having a through bar disposed between said ramp faces and arcuate concave surfaces and lying beneath said spring body portion and being retained thereby in assembled relationship with the slider body, and including said through bar of the pull tab being offset laterally from the longitudinal axis of the pull tab and being elongated in its cross sectional shape along the axis of the pull tab and having a guide lug projecting from one side of said through bar, and said slider body having a longitudinal guide groove receiving and guiding said lug during rotation of the pull tab.

2. A locking slider for a slide fastener as defined in claim 1, and one of said crown portions having an end recess at the end of the slider body adjacent to said post, and a bent retaining terminal on the end of the spring body portion remote from said tooth disposed in said recess.

3. A locking slider for a slide fastener as defined in claim 2, and said one crown portion having said end recess also having a longitudinal tapering internal chamber for the guidance of said spring through said one crown portion and into the end recess.

4. A locking slider for a slide fastener as defined in claim 1, and said spring body portion when in a relaxed locking mode extending substantially across and between said arcuate concave surfaces substantially at the centers of curvature thereof.

5. A locking slider for a slide fastener as defined in claim 1, and said retaining leaf being of a substantially reduced thickness compared to the thickness of the spring body portion throughout most of the length of the retaining leaf.

6. A locking slider for a slide fastener as defined in claim 1, and said guide groove being formed in one of said wings of the slider body adjacent to and across said cross passage.

7. A locking slider for a slide fastener comprising a unitary slider body having longitudinally spaced crown portions thereon separated by a cross passage, said crown portions having substantially aligned internal passage means extending longitudinally therethrough and intersecting said cross passage, a unitary locking spring for the slider having a longitudinal body portion insertable through said aligned internal passage means and having a spring retaining leaf projecting from one side of the spring body portion and adapted to snap into said cross passage and lockingly engage one end face of one of said crown portions, the separated opposing ends of the crown portions having cam surfaces thereon on opposite sides of the cross passage, the spring body portion spanning said cam surfaces longitudinally of the slider body, a locking tooth extension on said spring at one end of the spring body portion and projecting into a longitudinal passage of the slider body through which coupling elements of a slide fastener pass in the operation of the slider, a pull tab for the slider having a transverse bar disposed between said cam surfaces and beneath the body portion of said spring and being adapted to cammingly engage the spring body portion to retract the locking tooth extension when the pull tab is pulled in either direction of movement of the slider, and including said pull tab transverse bar being offset from the plane of the pull tab at one side thereof and being of elongated substantially rectangular cross section and having a guide lug projecting at one side thereof, and the slider body having a guide passage formed therein receiving said lug and guiding said pull tab during rotation of the pull tab.

8. A locking slider for a slide fastener as defined in claim 7, and said passage means in one of said crown portions being longitudinally tapered for the guidance of the locking spring therethrough, said one crown portion also having an end recess receiving a leading end portion of said spring and said leading end portion being bent within said end recess for the retention of the spring within said one crown portion.

* * * * *